United States Patent [19]

Wilkinson et al.

[11] Patent Number: 5,046,727

[45] Date of Patent: Sep. 10, 1991

[54] WRIST EXERCISE DEVICE

[75] Inventors: William T. Wilkinson, Chesapeake City, Md.; Gregory J. Gayle, Wilmington, Del.

[73] Assignee: Whatnot, Inc., Cleveland, Ohio

[21] Appl. No.: 560,781

[22] Filed: Jul. 31, 1990

[51] Int. Cl.[5] ..... A63B 21/105; A63B 21/045; A63B 21/012

[52] U.S. Cl. ..... 272/141; 272/67; 272/140; 272/131; 272/143

[58] Field of Search ..... 272/140, 141, 67, 68, 272/143, 131, 132

[56] References Cited

U.S. PATENT DOCUMENTS

| | | | |
|---|---|---|---|
| 2,668,055 | 2/1954 | Sharp et al. | 272/68 |
| 3,666,267 | 5/1972 | Mckinney | 272/67 |
| 3,708,164 | 1/1973 | Griffin | 272/67 |
| 4,591,151 | 5/1986 | Hensley | 272/67 |
| 4,695,049 | 9/1987 | Ciemiega | 272/67 |
| 4,838,542 | 6/1989 | Wilkinson | 272/67 |

*Primary Examiner*—Richard J. Apley
*Assistant Examiner*—Karen G. Horowitz
*Attorney, Agent, or Firm*—Connolly & Hutz

[57] ABSTRACT

A wrist exercise device includes a hollow shaft which houses a pair of compression springs. Tension disks are provided at the remote ends of the springs. The disks are moved toward and away from each other by turning a tension knob at one end of the device to increase or decrease the resistance from a pair of friction pads on each side of a handle at each end of the device. A resistance indicator is provided at one end of the device.

17 Claims, 4 Drawing Sheets

WRIST EXERCISE DEVICE

BACKGROUND OF INVENTION

U.S. Pat. No. 4,838,542 relates to a wrist exercise device which is based upon various concepts disclosed in U.S. Pat. No. 3,856,267. The '542 patent is particularly noteworthy in its ability to provide a wrist exercise device which may be used for strengthening the wrist and forearm. One of the features of the device is to include detachable weights for varying the exercise program.

It would be desirable to provide a wrist exercise device along the lines of the '542 and '267 patents which would be simple to manufacture and easy to operate or use while still retaining the advantages of the devices of the '542 and '267 patents.

SUMMARY OF INVENTION

An object of this invention is to provide a wrist exercise device which utilizes the advantages of the '542 and '267 patents.

A further object of this invention is to provide such a device wherein the amount of resistance may be readily adjusted while providing a setting which is visible to the user which reflects the amount of resistance.

In accordance with this invention, the wrist exercise device includes a hollow shaft which houses a pair of compression springs. Tension disks are mounted at remote ends of the springs. The disks are moved toward and away from each other by turning a tension knob secured at one end of the device. A marker on the tension knob rotates relative to a scale on its adjacent tension disk to reflect the resistance setting that results upon the increase or decrease of resistance afforded by a pair of friction pads on each side of a handle at each end of the device.

The device may also be provided with grip rings detachably secured around the handle to accommodate different hand sizes of users.

THE DRAWINGS

DETAILED DESCRIPTION

Figures 5, 6, 7, 8, 9:
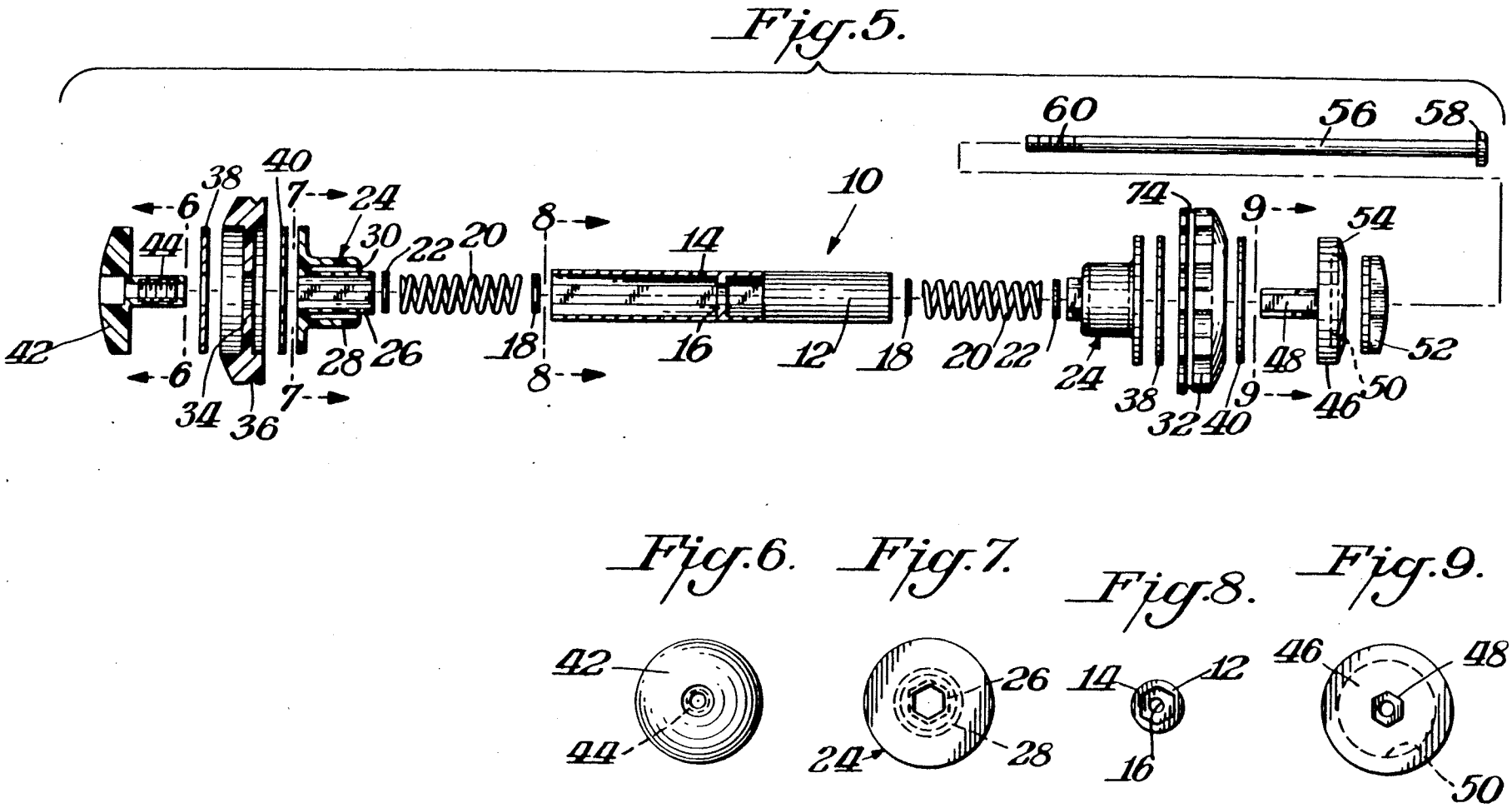
FIG. 5 is an exploded view of the device shown in FIGS. 3-4.
FIGS. 6-9 are elevational views taken in the direction of the arrows 6—6 through 9—9 in FIG. 5.
Figure 10:
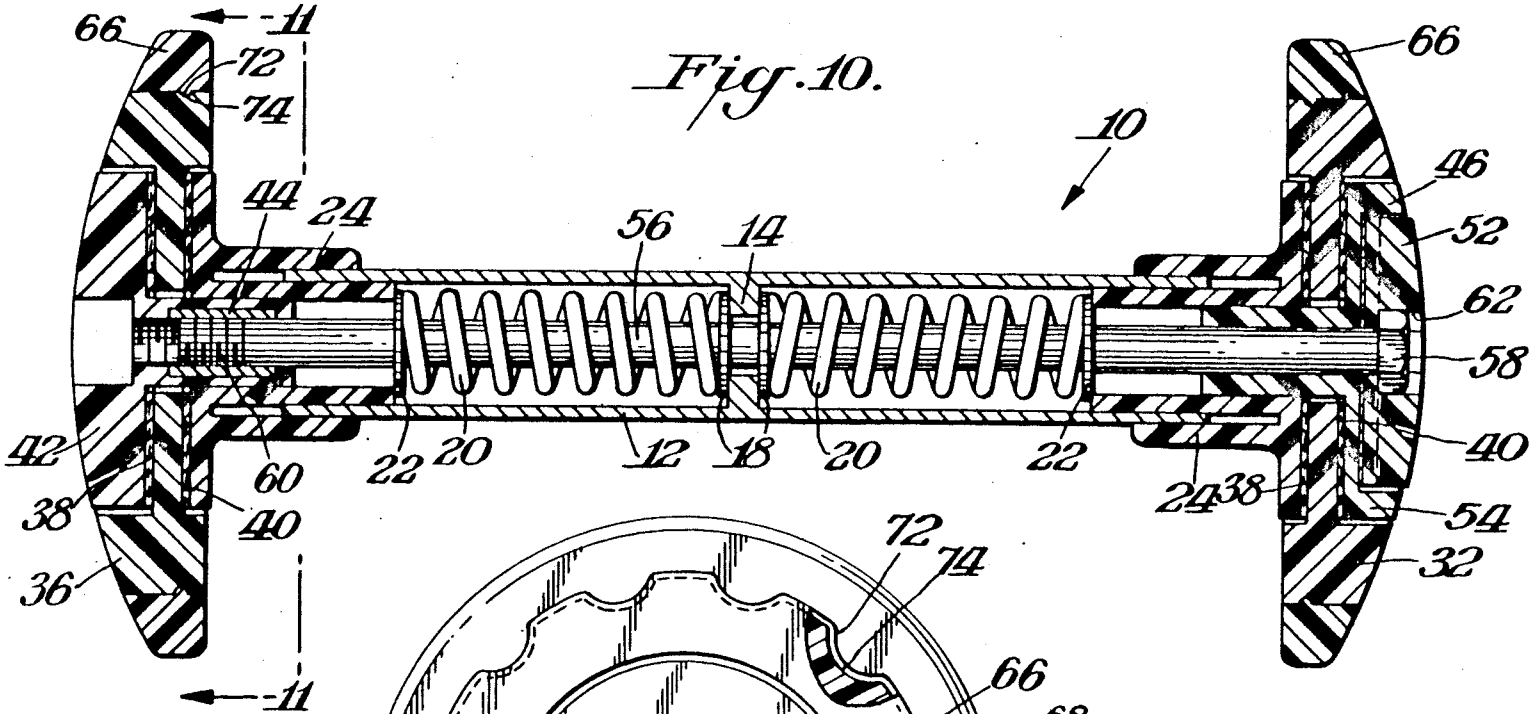
FIG. 10 is a cross-sectional view taken through FIG. 2 along the line 10—10, with the grip rings attached.

The present invention is based upon variations of the wrist exercise devices shown and described in U.S. Pat. Nos. 4,838,542 and 3,666,267 the details of which are incorporated herein by reference thereto. The various components for the wrist exercise device 10 are illustrated in FIG. 5 which shows the individual components prior to assembly while FIG. 10 clearly illustrates the components in their assembled form. As shown therein, device 10 includes a hollow shaft 12 having a central partition 14 which includes an axial aperture 16. A washer 18 is provided for resting against each side of partition 16 to act as a contact face for a compression spring 20 which would be telescoped into each end of hollow shaft 12. A second set of washers 22 would be provided for the remote ends of springs 20. Each end of shaft 12 also includes an inner tension disk 24. As shown in FIG. 10 and in the left-hand portion of FIG. 5, each tension disk 24 includes an inner sleeve 26 spaced from an annular outer sleeve 28 to create a channel 30 therebetween. Inner sleeve 26 telescopes into shaft 12 while the shaft itself fits in gap or channel 30 surrounded by outer sleeve 28. As best shown in FIG. 10 the free end of inner sleeve 26 abuts against washer 22.

Figure 1:
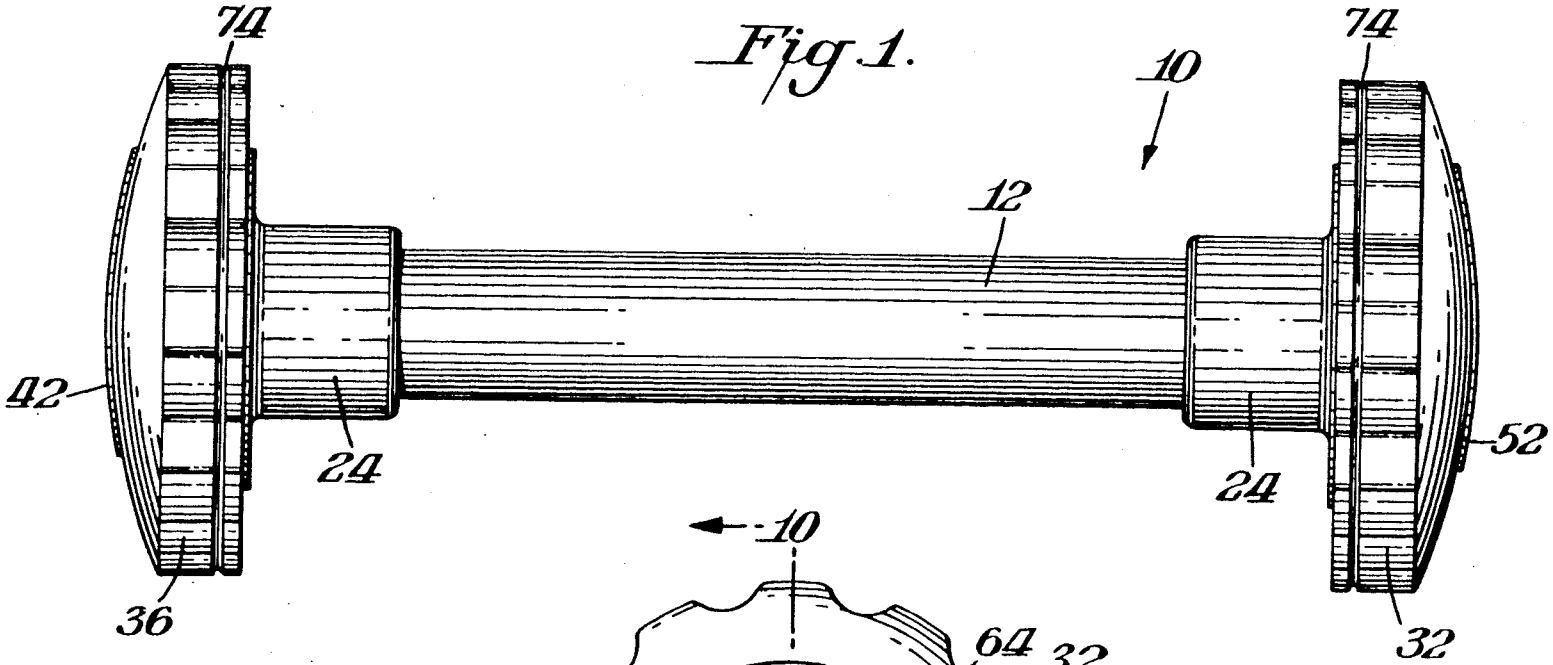
FIG. 1 is a side elevational view of a wrist exercise device in accordance with this invention.
Figure 2:
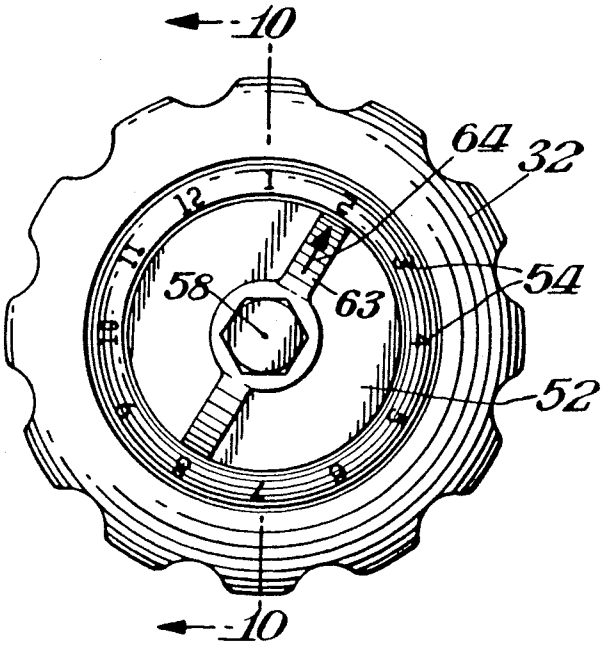
FIG. 2 is an end elevational view of the device shown in FIG. 1.
Figure 3:
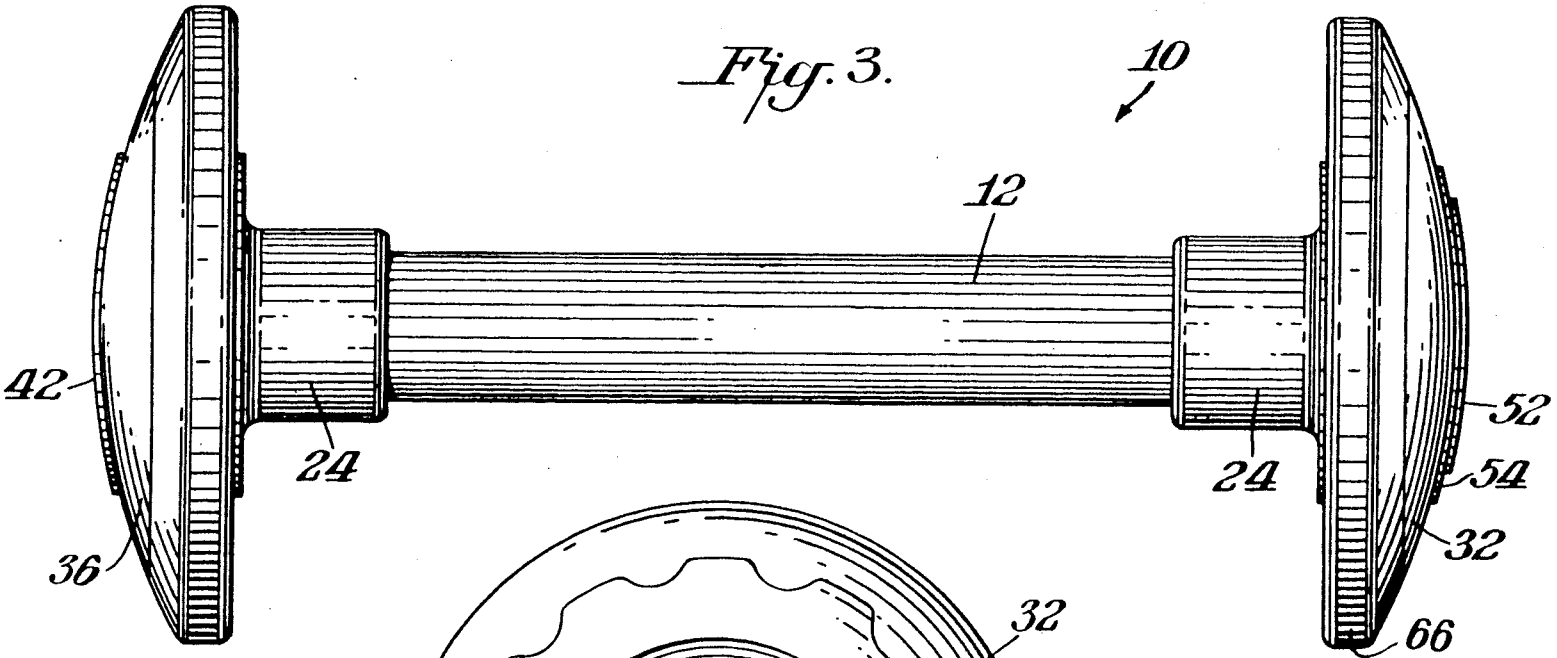
FIG. 3 is a side elevational view of the device shown in FIGS. 1-2 with grip rings attached.
Figure 4:
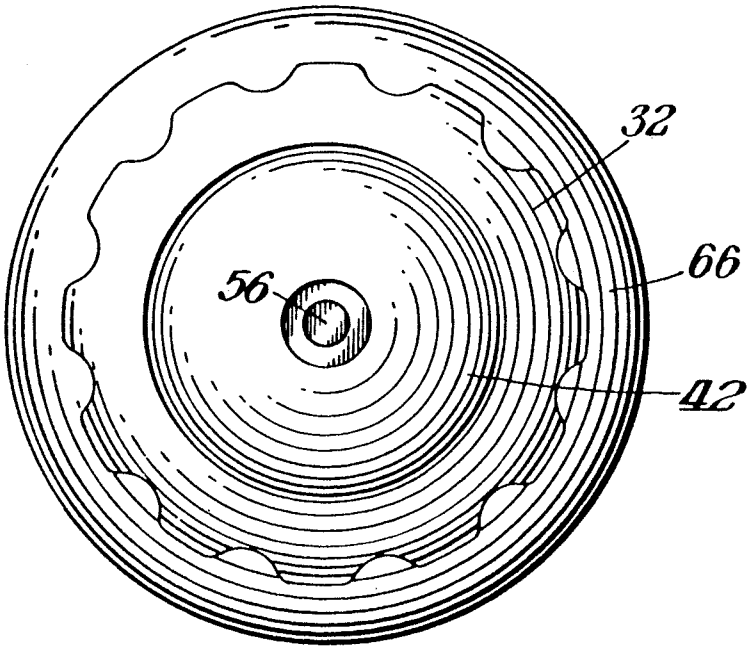
FIG. 4 is an end elevational view of the device shown in FIG. 3 taken from the end opposite that of FIG. 2.

Each end of device 10 is provided with a ring shaped handle 32 which includes a central web portion 34 and a flange 36 creating a pair of seats for leather friction pads 38,40. One end of device 10 includes an outer tension disk 42 which is illustrated in the left hand portion of FIGS. 5 and 10. Tension disk 42 includes an internally threaded hollow stem 44 for purposes later described. The opposite end of device 10 includes an outer tension disk 46 which has a smooth walled stem 48 and which includes an annular recess 50 for receiving tension knob 52. Outer tension disk 46 also includes an inclined wall or shoulder 54. As shown in FIG. 2 wall 54 includes a scale or series of markings which indicate the amount of resistance encountered when using device 10 as later described.

The various components of device 10 are secured together by an elongated screw 56 having a head 58 at one end and is threaded at the opposite end 60. As shown in FIG. 10, head 58 is received in recess 62 in tension knob 52. The main cylindrical body portion of screw 56 extends axial through smooth sleeve 48 of outer tension disk 46 and through inner sleeve 26 of inner tension disk 24 as well as through the axially holes in resistance pads 38,40 and in washers 18,22 and compression spring 20 on the right hand side of partition 14 in shaft 12. Screw 56 then extends axially through the corresponding components on the lefthand side of partition 14 with its threaded end 60 being threadably engaged in threaded sleeve 44 of tension disk 42.

In operation the user would turn tension knob 52 either clockwise or counterclockwise which would result in rotating screw 56 to draw tension disk 42 toward or away from opposite tension disk 46. For example, when tension knob 52 is turned clockwise tension disk 42 and tension disk 46 will be drawn closer together. As these two disks 42,46 are pulled closer toward the center of shaft 12 the springs 20,20 are reversing pressure on inner tension disks 24,24. This will cause a sandwich effect on leather resistance pads 38,40 against the web 34 of handles 36 at each end of device 10. The turning of tension knob 52 will also cause its indicator arrow 64 to change its relative position with respect to the scale or shoulder 54 on outer tension disk 46, as shown in FIG. 2. Thus, the more that tension knob 52 is turned clockwise the greater tension will be indicated by a higher number on the scale of shoulder 54. The greater tension is caused by the leather resistance pads 38,40 creating an increased friction between the tension disks and the handles 36,36.

The inside diameter and the outside diameter of inner tension disks 24,24 are both of non-circular complementary shape such as being hexagonal to prevent rotation therebetween. Additionally, the small outside diameters of outer tension disks 42,46 and the smaller inside diameter of inner tension disks 24,24 are non-circularly and preferably hexagonally shaped to prevent relative rotation with respect to shaft 12. In other words, all parts which should move together have non-circular complementary mating surfaces. Accordingly, when the user grips shaft 12 the only rotating parts will be the handle 32,32. Furthermore, equal friction will be obtained on both ends of device 10 by activating tension knob 52.

Figure 11:
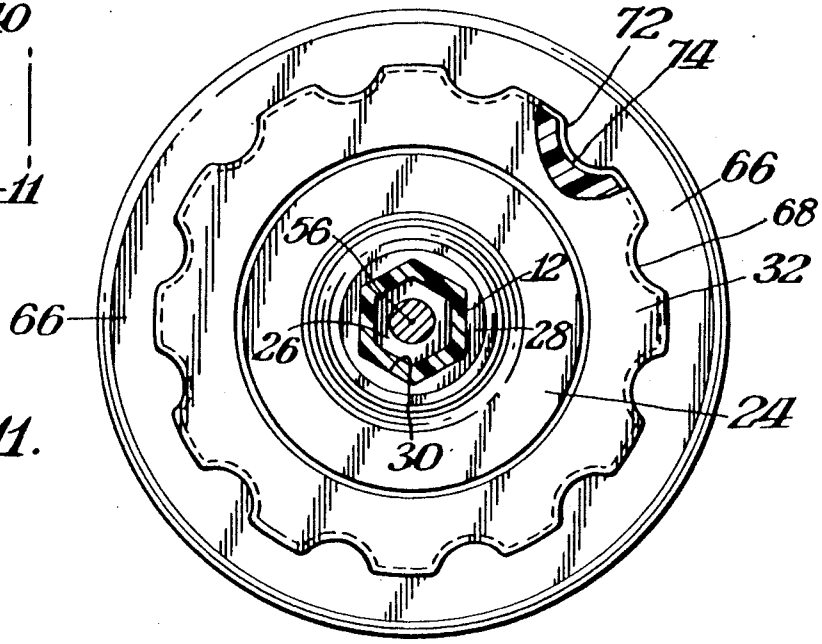
FIG. 11 is a cross-sectional view partly broken away taken along the line 11—11 in FIG. 10.

An optional feature of this invention is the provision of grip rings 66,66 which are best illustrated in FIGS. 10–11. As indicated each grip ring 66 includes a generally undulated inner surface having protusions 68 which snap into corresponding notches at the outer surface of handles 32. Grip rings 66 are thus detachably mounted to handles 32. Accordingly, different size grip rings could be attached to the handles 32 to vary the effect of outside diameter of the handles for accomodating different size hands of the users. Where grip rings 66 are not used the notches on the outer surface of handles 32 would conveniently function as finger notches. The engagement of projections 68 in the handle notches prevents relative rotation between grip rings 66 and handles 32. A further feature for assuring proper interlocking of the grip rings to the handles is a provision of an annular bead 72 on grip rings 66 which snaps into annular groove 74 along the outer surface of handle 32. This prevents any relative longitudinal movement between the grip rings and the handles.

Device 10 may be made of any suitable dimensions and materials. For example, the outer diameter of handles 32 might be about 3½ inches, while the overall length of device 10 could be about 7¾ inches. Device 10 may be made of any suitable plastic or metal materials although it is preferable that resistance pads 38,40 be made of leather. If desired, any portion that is gripped by the user may include a non-slip surface such as a rubberized or textured surface.

As can be appreciated, this invention thus provides a wrist exercise device which may be easily assembled for manufacturing purposes and wherein the amount of resistance may be conveniently adjusted while providing a setting to reflect the relative amount of resistance to assist the user in manipulating the exercise device.

What is claimed is:

1. A wrist exercise device comprising a hollow shaft; inner abutting means in the central portion of said shaft dividing the interior of said shaft into a pair of equal length chambers; a compression spring mounted in each of said chambers in said shaft on one side of and against said inner abutting means; an inner tension disk non-rotatably mounted to said shaft at each end of said shaft and disposed against a respective one of said springs; a first and second outer tension disk respectively mounted outwardly of each of said inner tension disks for joint rotational movement therewith, wherein said first outer tension disk has a stem with an internally threaded opening; a handle between each of said inner tension disks and its respective outer tension disk, each of said handles being rotatably mounted with respect to said shaft and said tension disks; at least one resistance pad between each of said handles and at least one of its associated tension disks; a turning knob mounted outwardly of said second outer tension disk, said turning knob having a recess; an elongate screw having a head at one end and being threaded at its other end, said screw extending through said second tension disk and through said inner tension disks and through said springs and through said abutting means in said shaft, said head of said screw being mounted in said recess of said turning knob, and said threaded end of said screw being threadably engaged with said threaded opening of said stem for selectively moving, by turning said turning knob, said outer tension disks toward and away from each other to vary the amount of resistance of said resistance pads with respect to the rotational movements of said handles.

2. The device of claim 1 including indicating means for visually indicating the relative amount of resistance.

3. The device of claim 2 wherein said second outer tension disk includes an annular resistance indicating scale, and said turning knob having a marker movable disposed adjacent said scale to comprise said indicating means.

4. The device of claim 3 wherein said turning knob includes a wall extending diametrically across said turning knob, said recess being in said wall, and said marker comprising a radially located arrow on said wall.

5. The device of claim 3 wherein one of said resistance pads is on each side of each of said handles.

6. The device of claim 5 wherein the outer peripheral surface of each of said handles includes longitudinal finger notches.

7. The device of claim 6 including a detachable gripping ring detachably mounted to said outer peripheral surface of each of said handles to increase the outer diameter of said handles.

8. The device of claim 7 wherein each of said gripping rings includes projections engaged in said finger notches.

9. The device of claim 8 wherein each of said gripping rings includes an annular bead seated in a groove in its handle.

10. The device of claim 9 wherein said shaft includes a central apertured partition with a washer on each side of said partition to comprise said abutting means.

11. The device of claim 10 wherein each of said handles includes a central web surrounded by a peripheral wall extending beyond said web on each side thereof to form a seat on each side of said web, and each resistance pad being in a respective seat.

12. The device of claim 11 wherein each of said inner tension disks includes a pair of spaced sleeves having an annular channel therebetween, and said shaft being telescoped into said channel.

13. The device of claim 12 wherein said shaft and said inner tension disks have non-circular contacting surfaces, and each of said outer tension disks and its respective inner tension disk having non-circular contacting surfaces.

14. The device of claim 1 wherein the outer peripheral surface of each of said handles includes longitudinal finger notches.

15. The device of claim 14 including a detachable gripping ring detachably mounted to said outer peripheral surface of each of said handles to increase the outer diameter of said handles.

16. The device of claim 15 wherein each of said gripping rings includes projections engaged in said finger notches.

17. The device of claim 16 wherein each of said gripping rings includes an annular bead seated in a groove in its handle.

* * * * *